US007360546B2

(12) United States Patent
Doi

(10) Patent No.: US 7,360,546 B2
(45) Date of Patent: Apr. 22, 2008

(54) CLEANING APPARATUS FOR SEMICONDUCTOR WAFER

(75) Inventor: Minoru Doi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 469 days.

(21) Appl. No.: 10/405,480

(22) Filed: Apr. 3, 2003

(65) Prior Publication Data

US 2003/0188770 A1 Oct. 9, 2003

(30) Foreign Application Priority Data

Apr. 9, 2002 (JP) ..... 2002-106655

(51) Int. Cl.
*B08B 3/00* (2006.01)
*B08B 3/12* (2006.01)

(52) U.S. Cl. ..... 134/102.1; 134/1; 134/12; 134/25.4; 134/105; 134/108; 134/155; 134/186; 134/902

(58) Field of Classification Search ..... 134/105, 134/108, 12, 902, 1, 25.4, 155, 186, 102.1
See application file for complete search history.

(56) References Cited

U.S. PATENT DOCUMENTS

| | | | | |
|---|---|---|---|---|
| 4,396,824 | A * | 8/1983 | Fiegl et al. | 392/480 |
| 5,158,100 | A * | 10/1992 | Tanaka et al. | 134/105 |
| 5,656,097 | A * | 8/1997 | Olesen et al. | 134/1 |
| 5,885,360 | A * | 3/1999 | Han et al. | 134/1 |
| 6,108,928 | A * | 8/2000 | Park et al. | 34/77 |

FOREIGN PATENT DOCUMENTS

| | | |
|---|---|---|
| CN | 1163802 | 11/1997 |
| CN | 1297385 | 5/2001 |
| JP | 64-042129 | 2/1989 |
| JP | 09-283489 | 10/1997 |
| JP | 11-111659 | 4/1999 |
| JP | 11-162923 | 6/1999 |
| JP | 11-354514 | 12/1999 |
| JP | 2000-040683 | 2/2000 |
| JP | 2001-044429 | 2/2001 |
| JP | 2001-102343 | 4/2001 |
| JP | 2001-185520 | 7/2001 |
| WO | WO 92/11498 | 7/1992 |

OTHER PUBLICATIONS

English Translation of Chinese Office Action dated Jun. 9, 2006.

* cited by examiner

*Primary Examiner*—Michael Barr
*Assistant Examiner*—Rita R Patel
(74) *Attorney, Agent, or Firm*—Nixon & Vanderhye P.C.

(57) ABSTRACT

A cleaning apparatus for a semiconductor wafer comprising: a double container including an inner container with an upper opening for accommodating a substrate to be cleaned and an outer container having an airtight space accommodating the inner container therein, the inner container being communicated to the outer container through the upper opening; a cleaning liquid supply conduit for supplying a cleaning liquid into the inner container; an inner container drain conduit for draining the cleaning liquid from the inner container; a solvent-containing gas supply conduit for supplying a solvent-containing gas into the inner container for drying the substrate; a solvent-resolving gas supply conduit for supplying a solvent-resolving gas into the inner container for resolving a solvent component attached on the substrate; an exhaust pipe for exhausting the gases from the double container, and an outer container drain conduit for draining the liquid spilled from the inner container to the outer container.

15 Claims, 5 Drawing Sheets

CLEANING APPARATUS FOR SEMICONDUCTOR WAFER

CROSS-REFERENCE TO RELATED APPLICATIONS

This application is related to Japanese Patent Application No. 2002-106655 filed on Apr. 9, 2002, whose priority is claimed under 35 USC §119, the disclosure of which is incorporated by reference in its entirety.

BACKGROUND OF THE INVENTION

1. Field of the Invention

The present invention relates to a cleaning apparatus for a semiconductor wafer used in the production process of semiconductors and the like. More particularly, the present invention is concerned with an immersion cleaning apparatus which cleans substrates i.e. silicon wafers and the like with immersing them in cleaning liquids.

2. Description of the Related Art

A cleaning system that uses a combination of cleaning fluids such as SPM (Sulfuric acid Hydrogen Peroxide Mix), APM (Ammonium Hydroxide Hydrogen Peroxide Mix), HPM (Hydrochloric acid Hydrogen Peroxide Mix) and HF (Hydrogen Fluoride) is widely used for a pre-cleaning treatment prior to the thermal diffusion oxidation treatment.

Japanese Patent Laid-open No. 2001-44429 discloses an embodiment of such system and methods using APM, HF and $H_2O_2$.

According to the above reference, the system includes at least two containers. In one of the containers is a one-bath-type cleaning container cleaning with hydrofluoric acid (HF), rinsing with a purified water and treating with a diluted solution of hydrogen peroxide are carried out, and in the other of the containers, a drying treatment using IPA (Isopropyl alcohol) is carried out.

The above system further includes four containers. One of them is a cleaning container for a first pre-diffusion cleaning using chemical materials for forming chemical oxide films and the other is a cleaning container for a second pre-diffusion cleaning to rinse off the chemical materials with a purified water.

In such a system, silicon wafers are moved from a clean room having a class 1 cleanliness to a wet cleaning apparatus. Then, the silicon wafers are moved into treatment containers in the cleaning apparatus by robot arms, and cleaning or drying processes are carried out, respectively.

After the cleaning and drying processes, the silicon wafers are returned into the clean room. The wet cleaning apparatus cleans 25 wafers at a time through batch processes.

As described above, at least two wet cleaning containers are used for the cleaning and drying processes those of which includes an APS cleaning, a purified water rinse, a hydrogen fluoride (HF) cleaning and an isopropyl alcohol (IPA) drying.

As illustrated in FIG. 6, the one-bath-type cleaning container includes a cleaning container body 120, a tray 130 to receive chemical solutions spilled from the body 120, a chemical solution supply conduit 301 connected to the bottom of the body 120, chemical solution supply lines 181,191,201 connected to the chemical solution supply conduit 301, and a waste solution line 302.

Each of the chemical solution supply line 181, 191, 201 supplies hydrogen fluoride, $H_2O_2$ and a purified water, respectively.

The chemical solutions each are supplied through the supply line 181, 191, 201 to a mixer 222 and mixed. The mixed solutions are injected into the cleaning container 120 through inlets at the bottom of the body 121. In the mixer 222, two or more chemical solutions are mixed up in a proper ratio based on a pre-determined concentration conditions.

A substrate i.e., silicon wafer having a large size for producing semiconductors reduces costs of products such as LSIs, since a larger number of products can be obtained from one substrate. Therefore, a larger substrate tends to be used.

It is just a time when a diameter of the wafer handled by semiconductor production equipments is transited from 200 mm to 300 mm. The introduction of those semiconductor production equipments for the wafer having a diameter of 300 mm in semiconductor production lines necessitates an semiconductor-cleaning apparatus corresponding to the wafer having a 300 mm in diameter.

However, mere enlargement of the cleaning apparatus results in a footprint (an occupation space required for installation of the apparatus) consumption. It is necessary that the apparatus has a processing capacity for larger wafers and a smaller footprint.

And also a cleaning apparatus used for cleaning wafers prior to a gate forming process or an oxide film forming process is required to have a higher cleanliness so that fewer residual contaminations such as particles of metals or organic substances remains on the wafer, corresponding to improvement on concentration and miniaturization of LSIs.

Conventionally, an IPA drying process is carried out after a liquid cleaning process. In this case, the residual IPA on the wafers has to be removed after the drying process, since organic substances must be removed prior to the oxide film forming process.

SUMMARY OF THE INVENTION

The present invention is directed to solve the problems pointed out above and therefore, it is an object of the invention to provide a semiconductor cleaning apparatus having a smaller footprint with respect to a size of substrates i.e., silicon wafers and a higher cleaning power.

The present invention provides a semiconductor cleaning apparatus for a semiconductor wafer comprising: a double container including an inner container with an upper opening for accommodating a substrate to be cleaned and an outer container having an airtight space accommodating the inner container therein, the inner container being communicated to the outer container through the upper opening; a cleaning liquid supply conduit for supplying a cleaning liquid into the inner container; an inner container drain conduit for draining the cleaning liquid from the inner container; a solvent-containing gas supply conduit for supplying a solvent-containing gas into the inner container for drying the substrate; a solvent-resolving gas supply conduit for supplying a solvent-resolving gas into the inner container for resolving a solvent component attached on the substrate; an exhaust pipe for exhausting the gases from the double container, and an outer container drain conduit for draining the liquid spilled from the inner container to the outer container.

DETAILED DESCRIPTION OF THE PREFERRED EMBODIMENTS

Figure 1:
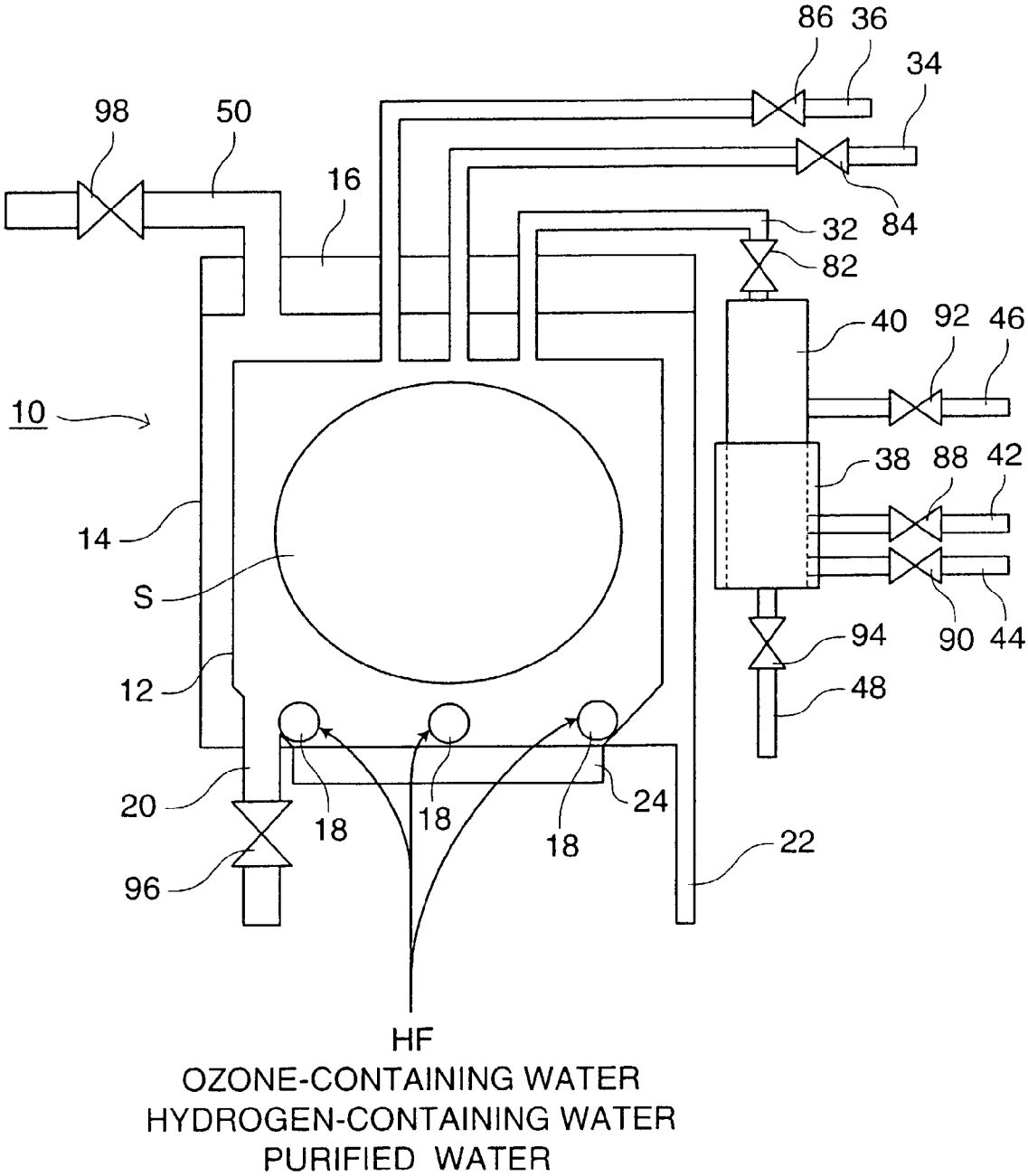
FIG. 1 is a schematic view of a preferred embodiment of immersion type semiconductor cleaning apparatus according to the present invention

A semiconductor cleaning apparatus according to the present invention comprises: a double container including an inner container with an upper opening for accommodating a substrate to be cleaned and an outer container having an airtight space accommodating the inner container therein, the inner container being communicated to the outer container through the upper opening; a cleaning liquid supply conduit for supplying a cleaning liquid into the inner container; an inner container drain conduit for draining the cleaning liquid from the inner container; a solvent-containing gas supply conduit for supplying a solvent-containing gas into the inner container for drying the substrate; a solvent-resolving gas supply conduit for supplying a solvent-resolving gas into the inner container for resolving a solvent component attached on the substrate; an exhaust pipe for exhausting the gases from the double container, and an outer container drain conduit for draining the liquid spilled from the inner container to the outer container.

According to this invention, the substrate accommodated in the inner container is cleaned and immersed in the cleaning liquid.

After completing the cleaning process, used cleaning liquid is drained from the inner container, followed by a drying process with the solvent-containing gas introduced into the inner container.

After drying the substrate, the solvent-resolving gas is supplied for resolving residual solvents on the substrate.

Above-mentioned processes are carried out in the double container, thereby keeping the footprint of the cleaning apparatus small.

According to another aspect of this invention, there is provided a cleaning apparatus for a semiconductor wafer comprising: a double container including an inner container with an upper opening for accommodating a substrate to be cleaned and an outer container having an airtight space accommodating the inner container therein, the inner container being communicated to the outer container through the upper opening; cleaning liquid supply conduits for supplying a hydrofluoric-acid-containing water, an ozone-containing water, a hydrogen-containing water and a purified water into the inner container; an inner container drain conduit for draining liquids from the inner container; gas supply conduits for supplying an inactive gas, an ozone gas and a solvent-containing gas into the inner container; an exhaust pipe for exhausting the gases from the double container, and an outer container drain conduit for draining the liquids spilled from the inner container to the outer container.

According to this invention, the substrate is cleaned by the hydrofluoric-acid-containing water, ozone-containing water, hydrogen-containing water and purified water supplied in a proper sequence into the inner container, and immersed in the inner container. The selection and applying sequence of those cleaning waters can be optionally determined according to the status or kind of the substrate. Same kind of cleaning water may be used more than once. The substrate is properly cleaned with those cleaning waters.

After the cleaning process, the cleaning waters in the inner container is drained through the inner container drain conduit, finally followed by introducing solvent-containing gas into the inner container for drying the substrate.

Then after drying with the solvent-containing gas, ozone-gas is supplied for resolving a residual solvent component on the substrate. Finally, the gas is exhausted through the exhaust pipe from the double container while introducing the inactive gas into the double container.

Whereby liquid cleaning process and drying process can be carried out in one bath so that the footprint of the cleaning apparatus is reduced to about half or less than the conventional two or multiple bath type apparatus. Further, the residual solvent component is resolved with this cleaning apparatus.

Herein, it is preferred to use a nitrogen gas as the inactive gas. And also it is preferred to use an isopropyl alcohol gas or the mixture of a nitrogen gas and that as the solvent-containing gas. Ethanol, methanol or xylene may used as a material of the solvent-containing gas.

It is preferred the inner container is made from quartz, Teflon (a trademark of polytetrafluoroethylene) or an acid resistant resin (e.g. PEEX) so that it endures the hydrofluoric-acid-containing water.

The cleaning apparatus may have a megasonic oscillator for vibrating the cleaning liquid in the inner container.

In particular, it is effective to vibrate the hydrogen-containing water during its treatment for removing contaminations.

An inlet of the inner container may includes a nozzle having holes of 0.5 mm diameter at intervals of 5 mm so as to provide uniform treatments.

In the inventive semiconductor cleaning apparatus, at least one part of the conduit for supplying the solvent-containing gas may include a silica tube with a heater, a solvent supply conduit and an inactive gas supply conduit, the silica tube receiving a solvent liquid and an inactive gas through the solvent supply conduit and the inactive gas supply conduit, respectively.

Wherein a solvent-containing gas for drying the substrate is obtained by supplying the liquid solvent into the silica tube through the solvent-supply conduit, heating it until gasified and, if needed, mixing the inactive gas supplied through the second inactive gas supply conduit. The solvent-containing gas produced in such manner is supplied into the inner container for drying the substrate. It is preferred to use a nitrogen gas as the inactive gas, which is supplied through the second inactive gas supply conduit.

Further, an ozone water supply conduit may be connected to the silica tube, thereby enabling the cleaning of the silica tube and the solvent-containing gas supply conduit with an ozone water.

It is preferred that hydrochloric acid is added to the ozone-containing water and ammonia is added to the hydrogen-containing water.

It is also preferred an ozone concentration of the ozone-containing water is 1 to 30 ppm, and a hydrogen concentration of the hydrogen-containing water is 1 to 30 ppm.

According to yet another aspect of this invention, there is provided a semiconductor cleaning apparatus, which comprises: a double container including an inner container with an upper opening for accommodating a substrate to be cleaned and an outer container having an airtight space accommodating the inner container therein, the inner container being communicated to the outer container through the upper opening; cleaning liquid supply conduits for supplying a hydrofluoric-acid-containing water, an ozone-containing water, a hydrogen-containing water and a purified water into the inner container; an inner container drain conduit for draining the liquid from the inner container; gas supply conduits for supplying an inactive gas, an ozone gas and a solvent-containing gas into the inner container; an exhaust pipe for exhausting the gases from the double container, and an outer container drain conduit for draining the liquids spilled from the inner container to the outer container, wherein each of the cleaning liquid supply conduits, the inner container drain conduit, the gas supply conduits and the exhaust pipe has a valve which is opened and closed by a controller, thereby cleaning the substrate and drying the substrate.

In this apparatus, the controller opens and closes each valve of the supply conduits of hydrofluoric-acid-containing water, ozone-containing water, purified water and hydrogen-containing water for cleaning the substrate, the valve of inner container drain conduit is opened for draining used cleaning liquids through the inner container drain conduit, followed by opening the valve of the gas supply conduit to supply the solvent-containing gas for drying the substrate, thereby enabling one-bath type cleaning which provides liquid cleaning and drying processes automatically and successively.

In the inventive semiconductor cleaning apparatus, the solvent-containing gas may include a mixture of an alcohol gas and a nitrogen gas, the alcohol gas being formed by heating alcohol with a heater situated on at least one part of the gas supply conduit for supplying the solvent-containing gas, wherein when the substrate is dried, the controller opens and closes the valve of the gas supplied conduit for supplying the solvent-containing gas and then opens and closes the valve of the gas supply conduit for supplying the ozone gas.

According to the above-mentioned procedure, the solvent component on the substrate is resolved by the ozone gas supplied subsequently to the drying process with the solvent-containing gas such as isopropyl alcohol gas.

In the inventive semiconductor cleaning apparatus, the controller may control the valves to carry out a dipping treatment of 60 to 1040 seconds for dipping the substrate in the ozone-containing water when the substrate is cleaned.

In the inventive semiconductor cleaning apparatus, the controller may control the valve to carry out a dipping treatment of 60 to 1040 seconds for dipping the substrate in the hydrogen-containing water when the substrate is cleaned.

Referring to the drawings, preferred embodiments of the present invention are described below.

FIG. 1 shows a schematic view of a preferred embodiment of immersion type semiconductor cleaning apparatus according to the present invention.

In FIG. 1, a cleaning container 10 for cleaning a substrate S (silicon wafer) includes a inner container 12 and an outer container 14 with a lid 16 which forms a part of the outer container 14 so as to seal an inner space accommodating the inner container 12. The inner container 12 has an upper opening. The inner container 12 is communicated to the outer container 14 through the upper opening. The inner container 12 has a bottom with nozzles 18 for receiving cleaning liquids thereinto. An inner container drain conduit 20 is connected to a drain outlet at the bottom of the inner container 12. The outer container 14 has a bottom with a drain outlet to be connected with an outer container drain conduit 22. The cleaning container 10 has a bottom which is common to the bottoms of the inner and outer containers. The bottom of the cleaning container 10 is provided with a megasonic oscillator 24 for vibrating the cleaning liquids in the inner container 12 so as to increase its cleaning power.

A solvent-containing gas supply conduit 32 for supplying solvent-containing gas, an ozone gas supply conduit 34 for supplying ozone gas and a nitrogen gas supply conduit 36 for supplying nitrogen gas used as an inactive gas are connected to the lid 16 so as to supply each gas into the inner container 12. An exhaust pipe 50 is also connected to the lid 16 so as to exhaust the gases from the inner container with the lid 16 closed.

The solvent-containing gas supply conduit 32 is connected to a silica tube 40 with a heater 38 wound around the tube 40. An IPA supply conduit 42, a second inactive gas supply conduit (nitrogen supply conduit) 44 and a second ozone-water supply conduit for cleaning the inside of the silica tube 40 are connected to the silica tube 40. A solvent, i.e., IPA is supplied through the IPA supply conduit 42 to the tube 40 to be heated up from 50 to 150° C. and gasified in the silica tube 40. The bottom of the silica tube has a silica tube drain conduit 48 for draining used IPA liquid. As the solvent, isopropyl alcohol is suitable. However, other solvents such as ethanol, methanol, xylene or the like may substitute for it.

The solvent-containing gas supply conduit 32, ozone gas supply conduit 34, inactive gas supply conduit 36, IPA supply conduit 42, second inactive gas supply conduit (nitrogen gas supply conduit) 44, ozone water supply conduit 46, silica tube drain conduit 48, exhaust pipe 50 and inner container drain conduit 20 have valves 82, 84,86, 88, 90, 92, 94, 98 and 96, respectively. Those valves are opened and closed by a controller 100 shown in FIG. 2.

Figure 2:
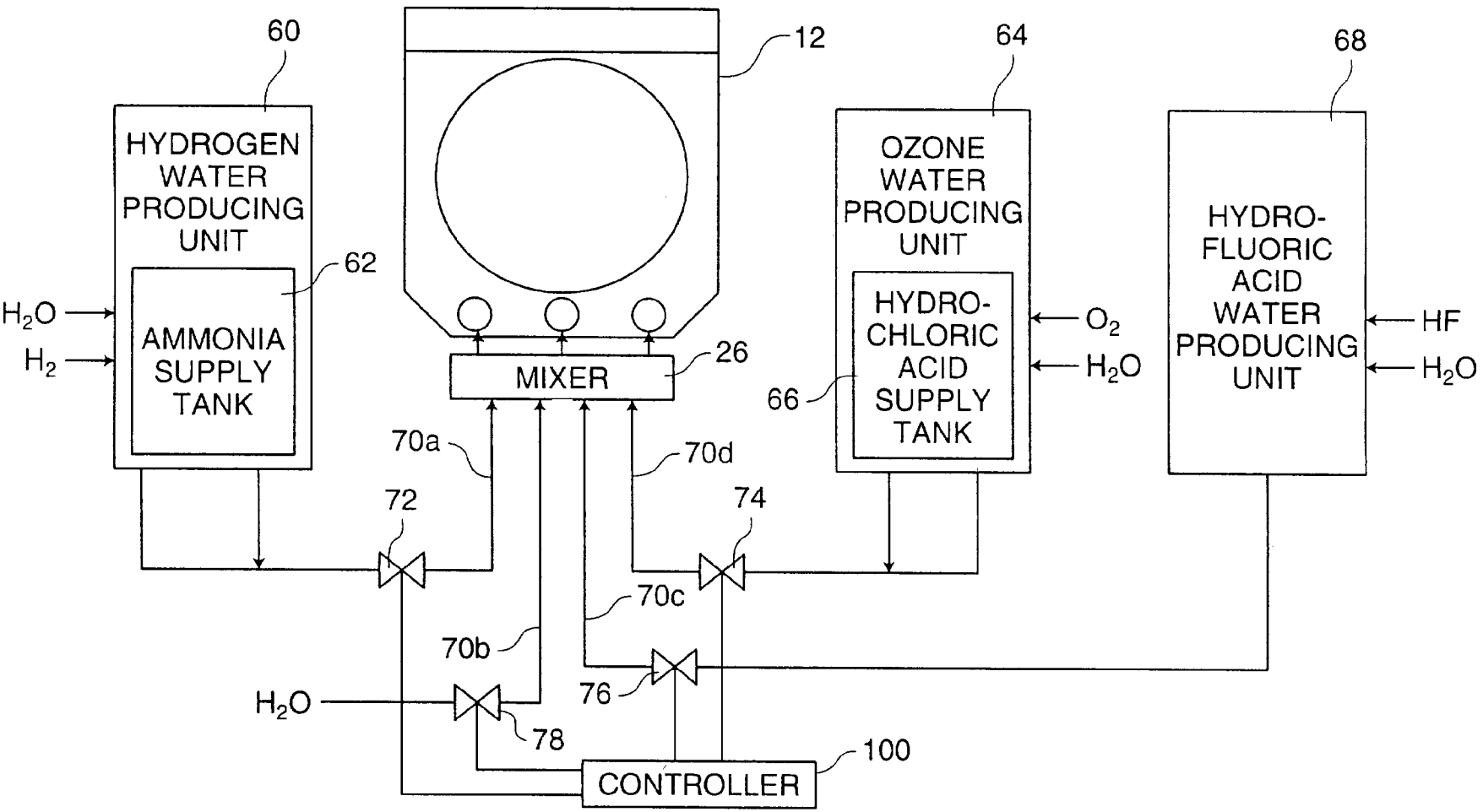
FIG. 2 is cleaning liquid supply system for supplying cleaning liquid in the semiconductor cleaning apparatus of FIG. 1.

FIG. 2 illustrates a cleaning liquid supply system for supplying the cleaning liquids into the inner container 12. In a hydrogen-containing water producing unit 60, hydrogen-containing water is produced from purified water and hydrogen. The unit 60 accommodates an ammonia supply tank 62 for adding ammonia to the hydrogen-containing water by 1 to 30 ppm. The added ammonia alkalizes the hydrogen-containing water to change particles in zeta-potential so that the particles cannot be reattached onto the substrates. The hydrogen-containing water produced in the hydrogen-containing water producing unit 60 is supplied into the inner container 12 through a hydrogen-containing water supply conduit 70*a* having a valve 70 which is opened and closed by the controller 100.

In an ozone-containing water producing unit 64, an ozone-containing water is produced from a purified water and an oxygen gas. The unit 64 accommodates a hydrochloric acid supply tank 66 for adding hydrochloric acid to the ozone-containing water by 1 to 30 ppm. The added hydrochloric acid acidizes the ozone-containing water to accelerate the detachment of the particles from the substrates because the ionization tendency of metals is increased in the ozone-containing water which has a higher oxidation-reduction potential. The ozone-containing water produced in the ozone-containing water producing unit 64 is supplied into the inner container 12 through an ozone-containing water supply conduit 70*d* having a valve 74 to be opened and closed by the controller 100.

In a hydrofluoric-acid-containing water producing unit 68, a hydrofluoric-acid-containing water (diluted hydrofluoric acid) is produced from purified water and hydrogen fluoride. The hydrofluoric-acid-containing water produced in the hydrofluoric-acid-containing water producing unit 68 is supplied into the inner container 12 through a hydrofluoric-acid-containing water supply conduit 70*c* having a valve 76 to be opened and closed by the controller 100.

In addition, purified water is supplied into the inner container 12 through a purified water supply conduit 70*b* having a valve 78 to be opened and closed by the controller 100.

Those conduits are made from a chemical resistant material, for example, Teflon (polytetrafluoro ethylene).

The hydrogen-containing water supply conduit, purified water supply conduit, hydrofluoric-acid-containing water supply conduit and ozone-containing water supply conduit corresponding to 70*a*-70*d* are joined to a mixer 26 which is connected to the nozzles 18 of the inner container 12 through common output conduits. The nozzles 18 have a number of holes of 0.5 mm diameter at intervals of 5 mm so that the cleaning liquids are uniformly injected into the inner container 12.

Thereafter, a cleaning procedure according to the semiconductor cleaning apparatus of the present invention is described.

Figure 3:
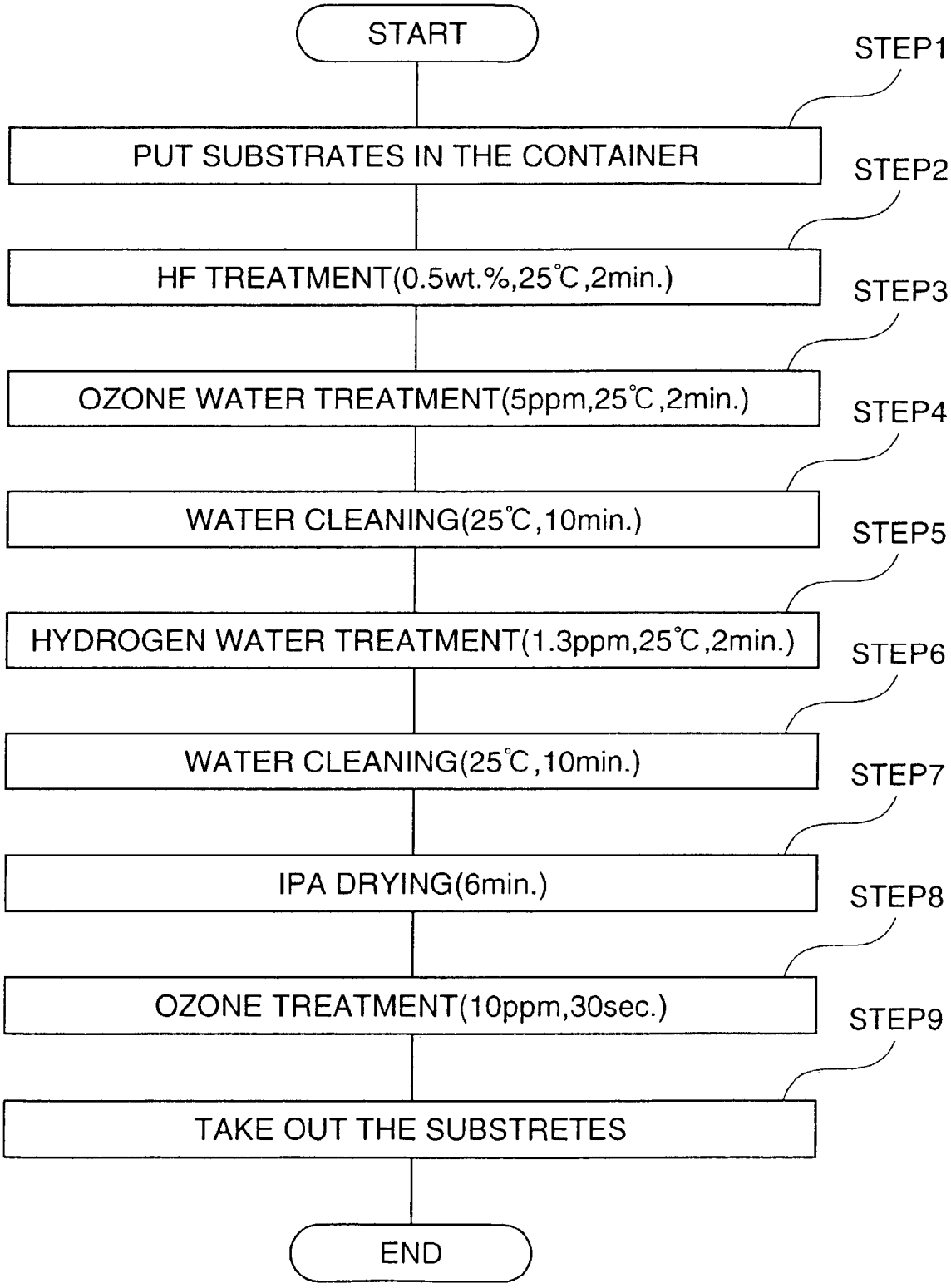
FIG. 3 is an example of cleaning process.

As shown in FIG. 1, a cleaning process of the substrates is carried out by properly supplying the hydrofluoric-acid-containing water (diluted hydrofluoric acid), hydrogen-containing water, ozone-containing water and purified water. FIG. 3 is an example of the cleaning process of the substrates. The controller 100 carries out the following steps.

Step 1.

The controller 100 opens the valve 76 to supply the hydrofluoric-acid-containing water into the inner container 12 and fill it therein. A robot arm (not shown) carries the substrates and places them into the inner container 12. Then the substrates are immersed into the hydrofluoric-acid-containing water filled in the inner container 12.

Step 2.

An etching treatment is carried out by the hydrofluoric-acid-containing water under a condition where with hydrofluoric-acid is 0.5 wt. %, the liquid temperature is 25° C. and the processing time is 2 min.

Step 3.

Then, the valve 74 is opened for supplying the ozone-containing water through the nozzles 18 into the inner container until it overflows and replaces all the liquid in the inner container. A cleaning treatment is carried out by the ozone-containing water under a condition where ozone is 0.5 wt. %, the liquid temperature is 25° C. and the processing time is 2 min.

Step 4.

Then, the valve 78 is opened for supplying the purified water through the nozzles 18 into the inner container until it overflows and replaces all the liquid in the inner container. A cleaning treatment is carried out by the purified water under a condition where the liquid temperature is 25° C. and the processing time is 10 min.

Step 5.

Then, the valve is opened for supplying the hydrogen-containing water through the nozzles 18 into the inner container until it overflows and replaces all the liquid in the inner container. A cleaning treatment is carried out by the hydrogen water under a condition where hydrogen is 1.3 ppm, the liquid temperature is 25° C. and the processing time is 2 min.

Step 6.

Then, the valve 78 is opened for supplying the purified water through the nozzles 18 into the inner container until it overflows and replaces all the liquid in the inner container. A cleaning treatment is carried out by the purified water under a condition where the liquid temperature is 25° C. and the processing time is 10 min.

Step 7.

Then, the valve 96 is opened for draining the cleaning liquids through the inner container drain conduit 20. Simultaneously, the valve 82 is opened for supplying the IPA gas for drying into the inner container 12. During six minutes, a drying process is carried out. Herein the IPA gas is obtained by heating the IPA liquid supplied into the silica tube 40 with the heater 38.

At the same time, the valve 90 is opened for supplying the inactive gas, i.e., nitrogen which functions as a carrier gas.

Step 8.

Then, the valve 84 is opened for supplying the ozone gas for resolving IPA. The treatment is carried out under a condition where ozone is 10 ppm and the processing time is 30 min.

Step 9.

Then, the substrates are removed from the inner container 12. The cleaning process is completed with those procedures. The ozone water is supplied through the ozone water supply conduit 46 into the silica tube 40 to clean the inside of the silica tube 40, and the used ozone water is drained out through the silica tube drain conduit 48.

In this embodiment, the cleaning and drying processes are carried out by the hydrofluoric-acid-containing water treatment, ozone-containing water treatment, purified water rinse, hydrogen-containing water treatment, IPA drying, and ozone gas treatment. However the order and combination of the hydrofluoric-acid-containing water treatment, ozone-containing water treatment, purified water rinse and hydrogen-containing water treatment may be optionally selected.

The densities of the cleaning liquids are not limited to that of the above-mentioned examples. It has been confirmed that a hydrofluoric-acid-containing water of 1 to 5 wt. %, a hydrogen-containing water of 1 to 5 ppm and an ozone-containing water of 1 to 30 ppm provides preferred cleaning results.

And in above-mentioned example, ammonia is added to the hydrogen-containing water by 1 to 50 ppm and hydrochloric acid is added to the ozone-containing water by 1 to 50 ppm in order to increase their cleaning power.

Figure 4:
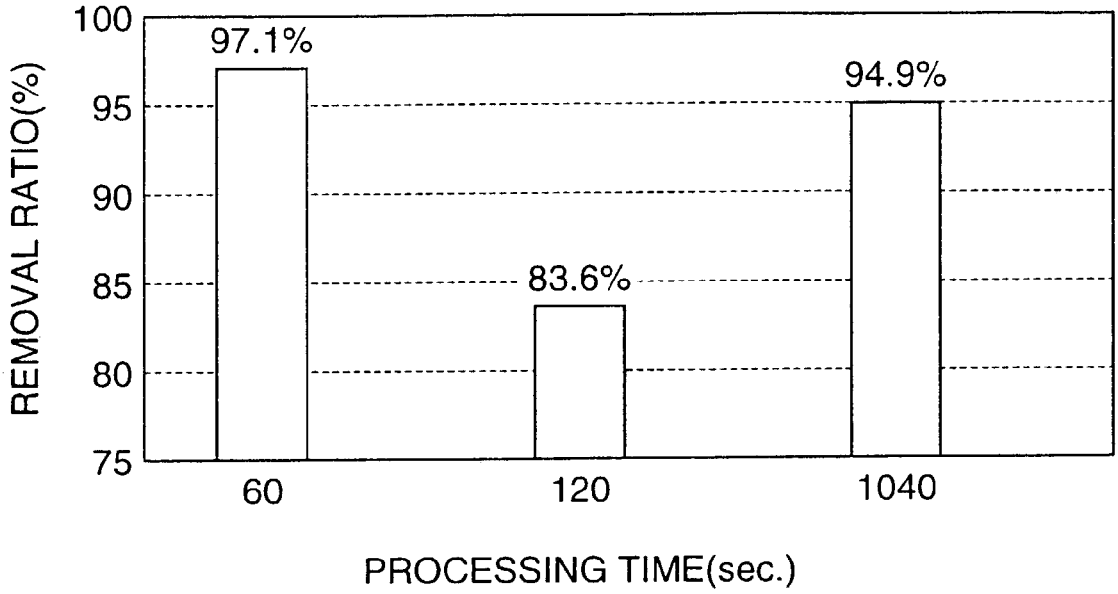
FIG. 4 is an experimental result of cleaning power that removes $Al_2O_3$ particles on the substrate.

FIG. 4 shows particle removal effects represented as a cleaning time dependence due to the hydrogen-containing water cleaning treatments. The cleaning treatment was experimented under such conditions that the hydrogen-containing water contained by hydrogen of 1.3 ppm, the liquid temperature was a room temperature and the cleaning time was changed.

As shown in FIG. 4, removal ratios of 83 to 97% was obtained under cleaning times of 60, 120 and 1040 seconds.

This shows any one of the cleaning times of 60, 120 and 1040 seconds in the hydrogen water cleaning is effective.

The substrates (sample wafers) used for this experiment are silicon wafers with $Al_2O_3$ particles attached.

A commercial particle counter having a minimum countable size of 0.12 $\mu m^2$, and utilizing diffused reflection of laser beams was used to count the particles.

Figure 5:
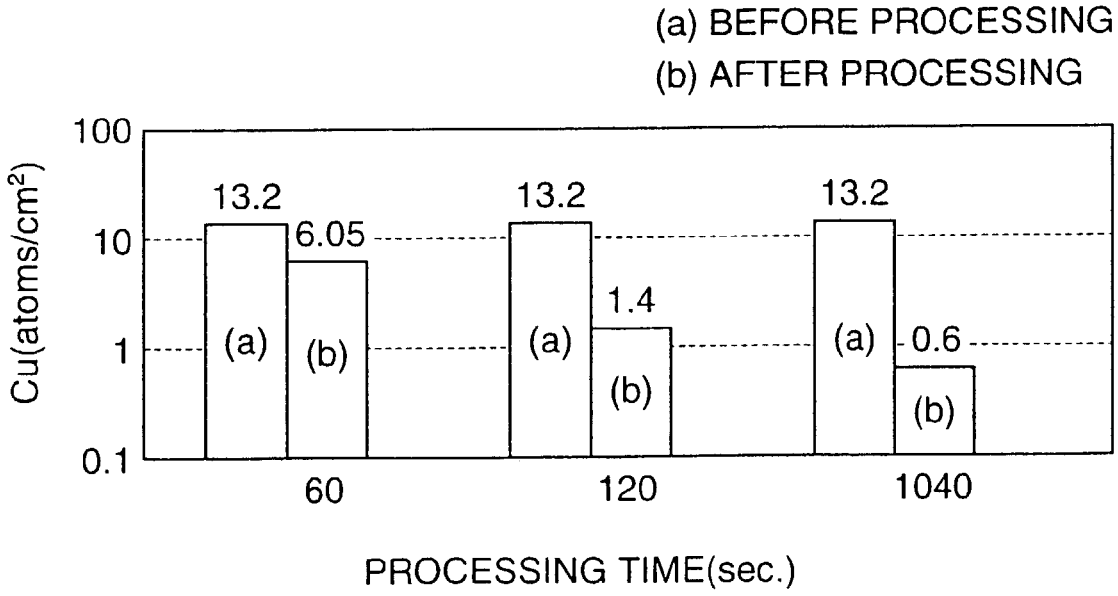
FIG. 5 is an experimental result of cleaning power by ozone-containing water.
Figure 6:
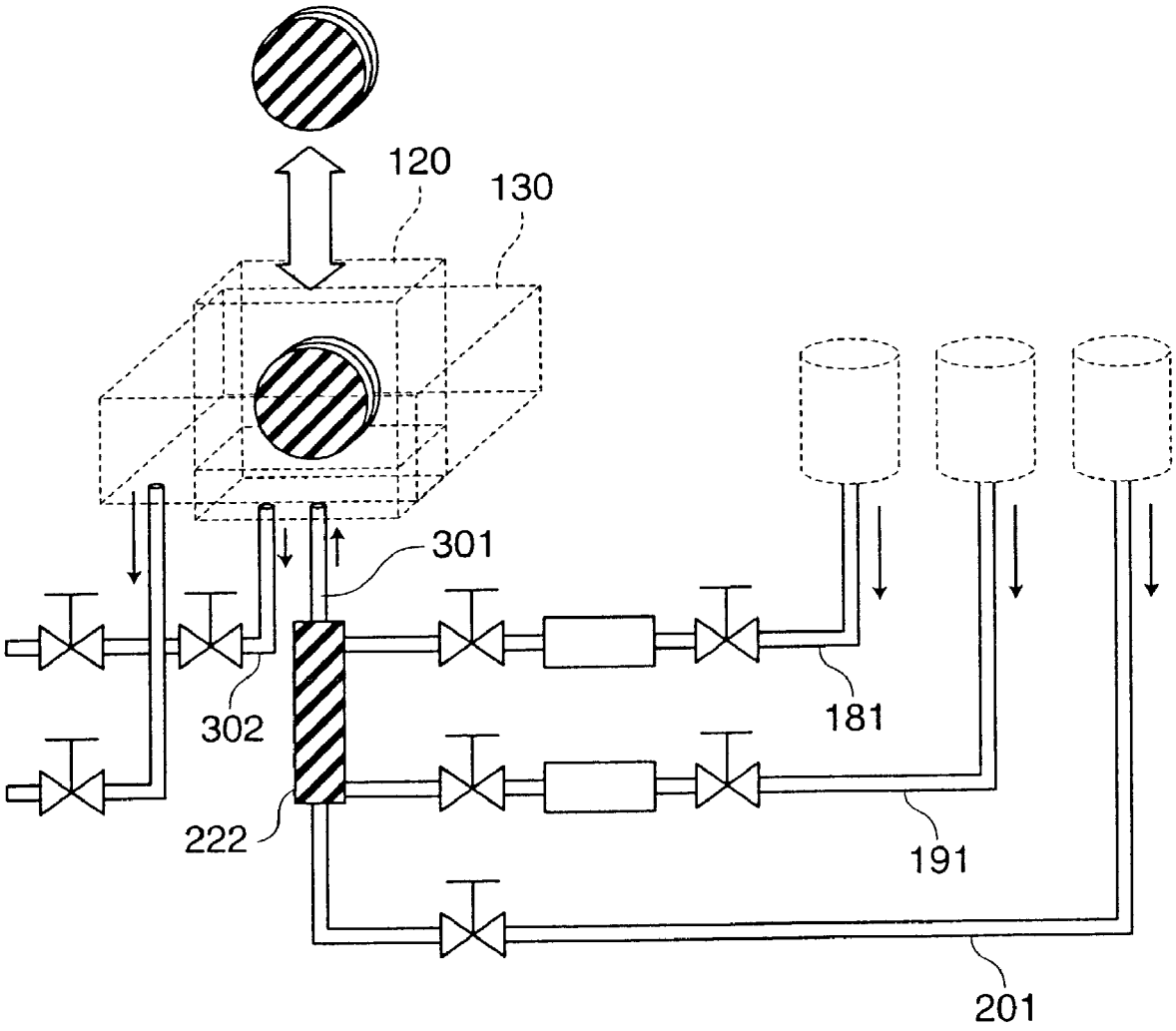
FIG.6 (PRIOR ART)
FIG. 6 is a schematic view of a conventional semiconductor cleaning apparatus.

FIG. 5 shows Cu removal effects of the ozone-containing water cleaning treatment shown in FIG. 3 which was used for substrates contaminated with Cu.

The cleaning treatment was experimented under such conditions that an ozone-containing water containing ozone of 2.4 ppm and hydrochloric acid is used at room temperature and the processing time was changed. As shown in FIG. 5, Cu removal ratio depends on the processing time.

In case of a processing time of 60 seconds, measurement values of Cu on the wafers before and after the ozone water treatment are 13.2×E10 (atoms/sq.cm) and 6.0×E10 (atoms/sq.cm), respectively, that means the Cu was removed by 54%.

In case of 120 seconds, the corresponding measurement values are 13.2×E10 (atoms/sq.cm) and 1.4×E10 (atoms/sq.cm), that means the Cu was removed by 89%.

In case of 1040 seconds, the corresponding measurement values are 13.2×E10 (atoms/sq.cm) and 0.6×E10 (atoms/sq.cm), that means the Cu was removed by 95%.

This shows the immersion processing time of 60-1040 sec. is effective and that of 120 or 1040 is more effective for removing Cu, when the ozone-containing water contains ozone of 2.4 ppm and hydrochloric acid and has a room temperature.

The substrates used for the experiment are silicon wafers contaminated with a standard solution for Cu atomic absorption. An inductively coupled plasma math spectrometry is used for counting Cu atoms.

According to the semiconductor cleaning apparatus of the present invention, one-bath-type cleaning apparatus that replaces a conventional multiple-bath-type apparatus is provided, thereby its footprint, that is, its occupation area in the room can be reduced to half or less.

Further, the order and combination of the hydrofluoric-acid-containing water treatment, ozone-containing water treatment, and hydrogen-containing water treatment may be optionally selected, thereby the substrates can be finished to have either a hydrophilic or hydrophobic surface which is required prior to the diffusion or CVD processing.

The attachment of organic substances such as IPA on the substrate may brings insufficient characteristics of products. In the cleaning treatment prior to the diffusion of the TD oxide film forming or gate forming process, the ozone gas treatment can resolve the residual IPA that is used for drying, thereby enabling removal of such organic components.

Further, a pure IPA gas can be obtained by heating IPA liquid in a silica tube. The silica tube is cleaned with ozone water after IPA gas production, thereby avoiding contamination in drying process.

By such features, the semiconductor wafer cleaning apparatus of the present invention achieves the required cleaning power and clean level of substrates, thereby enabling that the yield rate of products is increased and thus the productivity is enhanced.

What is claimed is:

1. A cleaning apparatus for a semiconductor wafer comprising:

a double container including an inner container with an upper opening for accommodating a substrate to be cleaned and an outer container having an airtight space accommodating the inner container therein, the inner container communicating with the outer container through the upper opening in the inner container, and the inner container is located substantially inside the outer container;

a cleaning liquid supply conduit for supplying a cleaning liquid into the inner container;

an inner container drain conduit for draining the cleaning liquid from the inner container;

a solvent-containing gas supply conduit for supplying a solvent-containing gas into the inner container for drying the substrate;

a solvent-resolving gas supply conduit for supplying a solvent-resolving gas into the inner container for resolving a solvent component attached on the substrate;

an exhaust pipe for exhausting the gases from the double container, an outer container drain conduit for draining the liquid spilled from the inner container to the outer container, wherein the outer container includes a top wall, a bottom wall, and lateral sidewall(s) which enclose the inner container therein; and wherein the solvent-containing gas supply conduit and the solvent-resolving gas supply conduit supply their respective gases directly into the inner container and thus not into the outer container.

2. A cleaning apparatus for a semiconductor wafer comprising:

a double container including an inner container with an upper opening for accommodating a substrate to be cleaned and an outer container having an airtight space accommodating the inner container therein, the inner container communicating with the outer container through the upper opening in the inner container, and the inner container is located substantially inside the outer container;

cleaning liquid supply conduits for supplying a hydrofluoric-acid-containing water, an ozone-containing water, a hydrogen-containing water and a purified water into the inner container;

an inner container drain conduit for draining liquids from the inner container;

gas supply conduits for supplying an inactive gas, an ozone gas and a solvent-containing gas into the inner container, wherein the gas supply conduits supply the inactive gas, the ozone gas and the solvent-containing gas directly into the inner container and thus not directly into the outer container;

an exhaust pipe for exhausting the gases from the double container, and an outer container drain conduit for draining the liquids spilled from the inner container to the outer container, wherein the outer container includes a top wall, a bottom wall, and lateral sidewall(s) which enclose the inner container therein.

3. A cleaning apparatus according to claim 1, wherein the inner container is made from one of quartz, polytetrafluoroethylene and an acid resistant resin.

4. A cleaning apparatus according to claim 1, further comprising a megasonic oscillator to vibrate the liquids in the inner container.

5. A cleaning apparatus according to claim 2, wherein the ozone-containing water contains hydrochloric acid.

6. A cleaning apparatus according to claim 2, wherein the hydrogen-containing water contains ammonia.

7. A cleaning apparatus according to claim 2, wherein the ozone-containing-water contains ozone of 1 to 30ppm.

8. A cleaning apparatus according to claim 2, wherein the hydrogen-containing-water contains hydrogen of 1 to 30ppm.

9. A cleaning apparatus according to claim 2, wherein at least one part of the conduit for supplying the solvent-containing gas includes a silica tube with a heater, a solvent supply conduit and an inactive gas supply conduit, the silica tube receiving a solvent liquid and an inactive gas through the solvent supply conduit and the inactive gas supply conduit, respectively.

10. The cleaning apparatus according to claim 9, wherein one of isopropyl alcohol, ethyl alcohol, methyl alcohol and xylene is used as the solvent liquid.

11. The cleaning apparatus according to claim 9, further comprising a second ozone-containing water supply conduit connected to the silica tube.

12. A cleaning apparatus for a semiconductor wafer comprising:

a double container including an inner container with an upper opening for accommodating a substrate to be cleaned and an outer container having an airtight space accommodating the inner container therein, the inner container communicating with the outer container through the upper opening in the inner container, and the inner container is located substantially inside the outer container;

cleaning liquid supply conduits for supplying a hydrofluoric-acid-containing water, an ozone-containing water, a hydrogen-containing water and a purified water into the inner container;

an inner container drain conduit for draining the liquid from the inner container;

gas supply conduits for supplying an inactive gas, an ozone gas and a solvent-containing gas into the inner container;

an exhaust pipe for exhausting the gases from the double container, and an outer container drain conduit for draining the liquids spilled from the inner container to the outer container, wherein the outer container includes a top wall, a bottom wall, and lateral sidewall(s) which enclose the inner container therein;

wherein the gas supply conduits supply the inactive gas, the ozone gas and the solvent-containing gas directly into the inner container and thus not directly into the outer container;

wherein each of the cleaning liquid supply conduits, the inner container drain conduit, the gas supply conduits and the exhaust pipe has a valve which is opened and closed by a controller, thereby cleaning the substrate and drying the substrate.

13. The cleaning apparatus according to claim 12, wherein the solvent-containing gas includes a mixture of an alcohol gas and a nitrogen gas, the alcohol gas being formed by heating alcohol with a heater situated on at least one part of the gas supply conduit for supplying the solvent-containing gas, wherein when the substrate is dried, the controller opens and closes the valve of the gas supplied conduit for supplying the solvent-containing gas and then opens and closes the valve of the gas supply conduit for supplying the ozone gas.

14. The cleaning apparatus according to claim 12, wherein the controller controls the valves to carry out a dipping treatment of 60 to 1040 seconds for dipping the substrate in the ozone-containing water when the substrate is cleaned.

15. The cleaning apparatus according to claim 12, wherein the controller controls the valve to carry out a dipping treatment of 60 to 1040 seconds for dipping the substrate in the hydrogen-containing water when the substrate is cleaned.

* * * * *